United States Patent [19]

Davies

[11] Patent Number: 4,924,211

[45] Date of Patent: May 8, 1990

[54] PERSONNEL MONITORING SYSTEM

[75] Inventor: Ronald C. Davies, Ft. Lauderdale, Fla.

[73] Assignee: Digital Products Corporation, Ft. Lauderdale, Fla.

[21] Appl. No.: 264,201

[22] Filed: Oct. 28, 1988

[51] Int. Cl.[5] ..... G08B 21/00

[52] U.S. Cl. ..... 340/573; 340/539; 340/825.49; 340/825.54; 379/38; 379/106; 455/67; 455/88

[58] Field of Search ..... 340/573, 539, 825.49, 340/825.54; 455/67, 66, 88, 89, 73, 78; 379/38, 106

[56] References Cited

U.S. PATENT DOCUMENTS

| | | | |
|---|---|---|---|
| 2,903,693 | 9/1959 | Ley | 455/78 |
| 2,939,139 | 5/1960 | Handler | 455/78 |
| 3,478,344 | 11/1969 | Schwitzgebel | 340/573 |
| 4,158,814 | 6/1979 | Imazeki et al. | 455/78 |
| 4,743,892 | 5/1988 | Zayle | 379/38 |
| 4,747,120 | 5/1988 | Foley | 379/38 |
| 4,777,477 | 10/1988 | Watson | 340/573 |

*Primary Examiner*—Glen R. Swann, III

*Attorney, Agent, or Firm*—Lerner, David, Littenberg, Krumholz & Mentlik

[57] ABSTRACT

A system for monitoring presence of persons at preselected monitoring locations. A plurality of local units, one at each monitoring location, determines whether the monitored person is present or absent at the monitoring location and sends report signals via free space radio transmission. A mobile unit, preferably mounted in a vehicle, passes within range of the various local units in order, and hence recovers status information. Desirably, the mobile unit provides a perceptible signal to an officer in the vehicle if the monitored person is absent. Each local unit may be arranged to receive radio signals from a tag carried by the monitored person and to provide an absence indication if the tag signals are no longer received. The same radio receiver as employed to receive the tag signals may also be employed to receive a callout signal sent by the mobile unit. The local unit may be arranged to provide an audible signal to the monitored person upon receipt of a callout signal, thus instructing the monitored person to present himself for inspection by the monitoring officer. The system permits an officer driving an automobile or walking a route carrying the mobile unit to monitor the status of any individuals in a house arrest program.

22 Claims, 2 Drawing Sheets

PERSONNEL MONITORING SYSTEM

BACKGROUND OF THE INVENTION

The present invention relates to personnel monitoring systems.

Electronic personnel monitoring systems have been utilized in the criminal justice field for maintaining control of persons subject to a term of house arrest. A person subject to house arrest is required to remain inside his home at all times or during specified hours. House arrest programs are considered useful alternatives to conventional incarceration for convicted criminals and for criminal defendants awaiting trial. Thus, a person sentenced to house arrest will not be subject to the influence of long term criminals in a prison environment. Moreover, the person sentenced to house arrest can maintain relationships with his family and community. The house arrest sentence may be arranged so that the subject person is permitted to leave the house during working hours, and hence may maintain his employment. Moreover, prison space is a scarce and expensive resource. House arrest sentencing conserves this resource.

To maintain effective control of persons subject to house arrest, the controlling authority must monitor their actual compliance with the house arrest program. Thus, the controlling authority must check to see if each monitored person is in his home. Although this theoretically could be done by having officers visit each home at frequent intervals, such an arrangement normally is impractical in that it would require a large number of officers to maintain effective, frequent surveillance of a large group of individual homes. Therefore, automatic systems have been developed for monitoring the presence of persons at their respective homes or other detention locations.

One system which has been widely adopted for this purpose is described in U. S. Pat. No. 4,747,120. As set forth in the '120 patent, telephone dialer means at a central location such as the office of the controlling authority automatically initiates telephone calls from the central location via the community telephone exchange to each home or other remote location where a person is to be monitored. Instruction signal means automatically provide an instruction signal perceptible to the monitored person at the remote location during each such telephone call. In response to this instruction signal, the monitored person performs a predetermined action resulting in transmission of return signals from the remote location to the central location via the telephone line. Test means are provided at the central location for automatically testing the return signals from each home or remote location to determine whether the predetermined action has been performed by the particular person who is supposed to be present at the remote location called. If the test means at the central location finds that the proper return signals have been returned when a particular person's home has been called, then the test means have automatically determined that the person is home. If not, an alarm is generated at the central location. Typically, the system includes an identifying object or tag such as a coded bracelet which is attached to each person to be monitored. The test means may include means for determining whether the identifying object associated with a person assigned to a particular remote location was employed to generate the return signals received from that location. If so, then the proper person is present.

Systems as described in the '120 patent provide effective monitoring of parolees and other persons subject to house arrest at reasonable cost and with excellent security. Other remote monitoring systems employ a small, low-powered radio transmitter secured to each monitored person and a combination radio receiver and telephone dialer at each remote monitoring location. The receiver normally detects radio frequency signals from the transmitter while the monitored individual is present. If the monitored individual leaves the vicinity of the transmitter, he takes the small transmitter out of range and hence the receiver no longer detects the transmitter signal. In response to such a loss of signal, the telephone dialer is activated to automatically place a call to the central office and transmit an alarm signal to the central office.

Both of these systems use the telephone network. One drawback which has limited application of these systems heretofore has been that some persons to be monitored do not have a telephone line available in their home. This problem in particularly severe in some rural areas, where many homes do not have telephone service. Even in highly developed, urban areas a significant portion of criminals are poor and do not have a home telephone. Accordingly, monitoring systems which require a telephone line to the home have not been useful in monitoring these individuals. Moreover, criminal justice authorities have been concerned that house arrest monitoring systems which require a telephone line will be viewed as discriminating against poor people. Thus, an impoverished person who does not have a telephone may be sent to a conventional jail because he cannot be placed on a house arrest monitoring program.

There have accordingly been needs for further improvement in personnel monitoring systems.

SUMMARY OF THE INVENTION

The present invention addresses these needs.

One aspect of the present invention provides apparatus for monitoring a plurality of persons at a plurality of preselected monitoring locations. The apparatus includes a plurality of local units. Each local unit is disposed at a monitoring location and thus associated with a person to be monitored at that particular monitoring location. Each local unit preferably includes detector means for determining the presence or absence of the associated person to be monitored and providing presence information accordingly. Each local unit preferably also includes report signal sending means for transmitting a report radio signal bearing the presence information through free space from the monitoring location. The apparatus further includes a mobile unit, which may be carried in a vehicle or on the person of a monitoring officer. The mobile unit includes report signal receiving means for detecting the report signal from the local unit at each monitoring location while the mobile unit is within range of the report signal from that local unit and recovering the presence information from the detected report signal. Thus, presence information regarding all of the persons to be monitored can be recovered by bringing the mobile unit within radio transmission range of all monitoring locations in a series.

Most preferably, the mobile unit includes presence status indication means for providing a perciptible indication at the mobile unit of the presence information recovered from each report signal during detection of the report signal. The mobile unit desirably further includes in-range indication means providing perceptible indication at the mobile unit whenever the mobile unit is detecting a report signal. Thus, a monitoring officer can determine whether the monitored persons are present at their respective monitoring locations merely by approaching the various monitoring locations and without physically inspecting each monitoring location. In a typical arrangement, each monitoring location may be the home of a parolee or other individual subject to supervision by a legal authority and the mobile unit may be carried in an officer's automobile. The officer can check that all of the parolees are present in their homes merely by driving his automobile along a route which takes him within range of the various homes. A single officer thus can check many parolees repetitively.

Preferably, each local unit includes a local unit radio receiver. The system may also include tag signal means carried by each person to be monitored for transmitting a tag radio signal associated with the monitored person. The radio receiver of each local unit is adapted to receive the tag radio signal associated with the person assigned to the location of that local unit. The detector means of the local unit preferably includes the radio receiver and means for providing a presence signal only while the radio receiver is receiving the associated tag signal and providing an absence signal when the radio receiver does not receive that tagged signal.

Most preferably, the mobile apparatus includes selectively operable callout signal sending means for sending a callout radio signal. The local unit radio receiver preferably is adapted to receive the callout signal as well as the tag signal. Callout signal indicating means may be provided at the local unit for providing a perceptible indication that a callout signal has been received upon reception of the callout signal by the local unit radio receiver. The perceptible callout indication may be an audible tone, illumination of a signal light or the like. In this arrangement, the local unit radio receiver is employed both as part of the detection means and also as a communication channel. The officer may send the callout signal whenever he wishes to see the monitored individual in person. In response to the perceptible callout indication, the monitored person knows that he should leave his home and present himself at a pre-selected location, typically in front of his home, where the officer can meet him. This callout capability greatly enhances the security of the system. Any attempt to defeat the system will be immediately apparent to the officer if the monitored person does not respond to a callout signal. Moreover, the officer can personally observe the monitored person at will without exposing himself to the possibility of attack or other dangers which may exist within the home. This greatly enhances officer's safety. In many cases, a single officer can safely monitor even relatively dangerous violence-prone individuals with reasonable safety.

Because the local unit need not be carried on the person of the parolee, the local unit can draw power from a normal electrical utility outlet in the parolee's home or else from a large, high capacity battery. Therefore, the report signal sending means may operate at a relatively high duty cycle, repetitively sending the report signal at reasonably short intervals such as every few seconds or less. This enhances the probability that the mobile unit will be able to detect the report signal. By contrast, the tag signal sending means may be arranged to send the tag signal at relatively long intervals, typically about thirty seconds or more, so as to conserve battery power. Moreover, the report signal transmitter may be positioned at a predetermined location in the home selected to enhance transmission to the outside environment, such as a location adjacent to a window. Therefore, the system can provide satisfactory detection of the report signal even if low powered transmitters are employed. The use of low powered transmitters is preferable inasmuch as it avoids the need for licenses from communications authorities.

Most preferably, the receiver of each local unit includes local code means defining a local identification code and means for rejecting radio signals which do not bear this local identification code. The local codes means in different local units typically defines different local identification codes. The tag signal means associated with each monitored person desirably includes means for incorporating the local identification code utilized by the associated local unit in the tag signal. The mobile unit typically includes means for selecting any one of the local identification codes and encoding the callout signal with the so-selected local identification code. Further, the local unit desirably includes means for encoding the report signal sent by that local unit with a report identification code. Different local units typically utilize different report identification codes, and the mobile unit preferably includes report identification code selection means for selecting any one of the report identification codes. The receiver of the mobile unit is arranged to respond only to radio signals bearing the so selected report identification code and to ignore other radio signals. Thus, the officer can set the callout signal sending means and the receiver of the mobile unit to cooperate with only one particular unit at a time. This avoids interference where plural local units are employed, and permits plural local units to operate on the same frequency. Desirably, the report identification code used by each local unit is different from the local identification code used by the same local unit. The tag signal sending transmitter, local unit receiver and report signal sending transmitter may all operate on the same radio frequency without appreciable interference.

Systems in accordance with preferred embodiments of the present invention can provide secure and effective personnel monitoring at minimal cost, and can be fabricated using readily available, standard components.

Further aspects of the present invention include monitoring methods and components, such as local and mobile units, useful in connection with the above-described apparatus.

These and other objects, features and advantages of the present invention will be more readily apparent from the detailed description of the preferred embodiment set forth below, taken in conjunction with the accompanying drawings.

BRIEF DESCRIPTION OF THE DRAWINGS

Figure a schematic block diagram of components utilized in apparatus according to one embodiment of the invention.

DETAILED DESCRIPTION OF THE PREFERRED EMBODIMENTS

Figure 2:
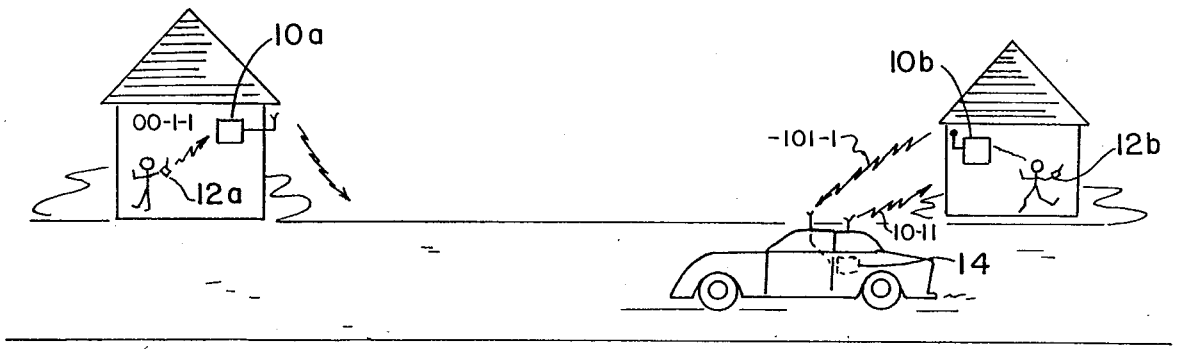
FIG. 2 is a further schematic diagram showing the same embodiment but on a smaller scale.

A monitoring system in accordance with one embodiment of the present invention includes a plurality of local monitoring units 10, of which two (10*a*,10*b*) are shown in FIG. 2. Each monitoring unit is disposed at a separate monitoring location. Thus, unit 10*a* is disposed in one home, whereas unit 10*b* is disposed in another. A tag 12 is carried by each person to be monitored, so that one such tag is associated with each monitored person. Each tag 12 is also associated with one local monitoring unit 10. For example, the monitored person carrying tag 12*a* is assigned to remain at the home monitored by local monitoring unit 1O*a*. Thus, tag 12*a* is associated with local monitoring unit 10*a*. In the same fashion, tag 12*b* is associated with local monitoring unit 10*b*. The apparatus further includes a mobile unit 14, which may be carried in an automobile.

Figure 1:
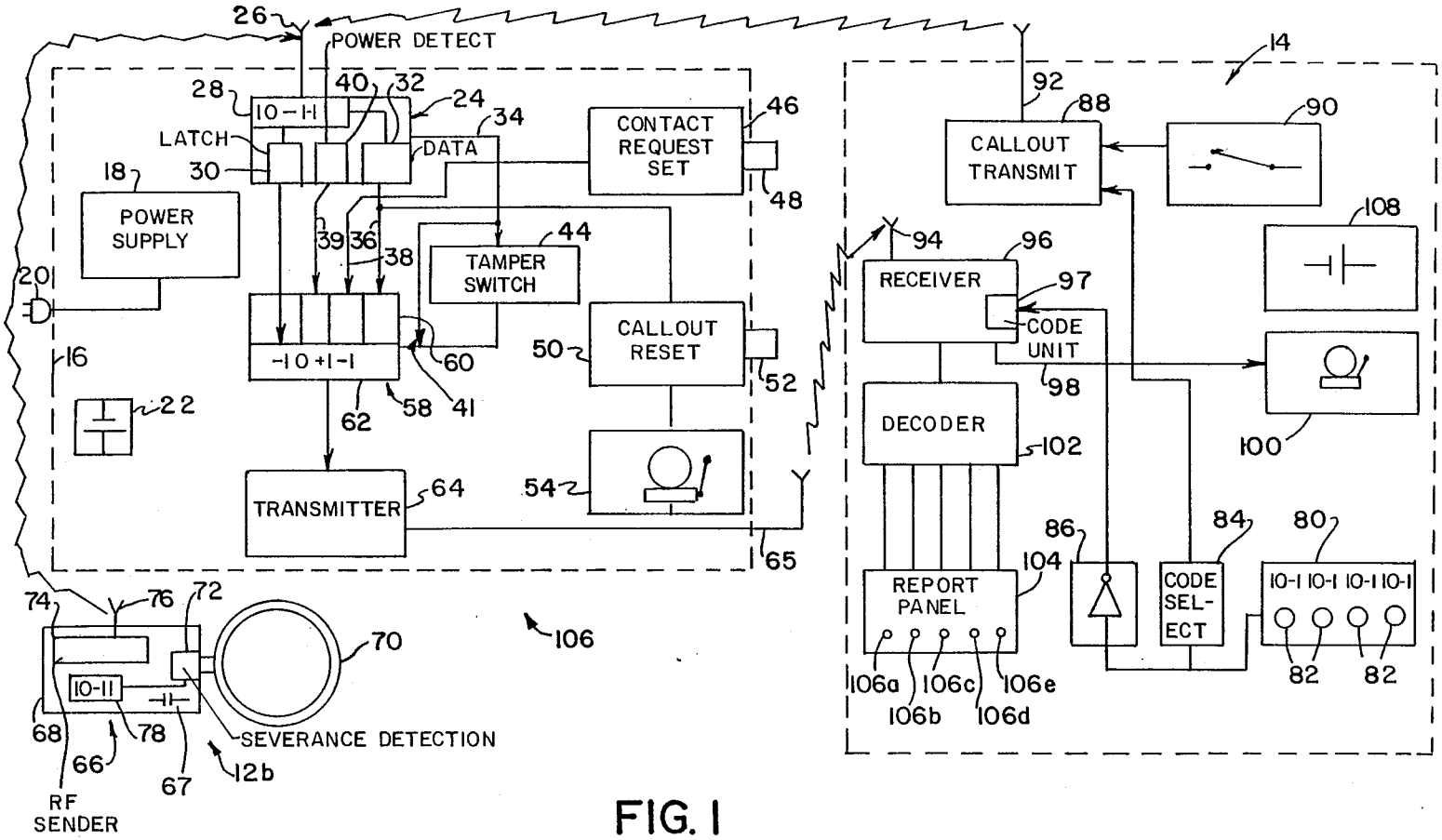

Each local unit 10 includes a housing 16 (FIG. 1). A conventional power supply unit 18 is mounted within housing 16. Power supply unit 18 is connected to a conventional plug 20 for drawing energy from a conventional utility outlet in the home. Local unit 10 further includes a backup battery power supply 22. Both of these components are arranged to supply low voltage DC power to the remaining components of the apparatus.

Each local unit 10 further incorporates a radio receiver 24 connected to a receiving antenna 26. Receiver 24 includes conventional components for amplifying and demodulating a radio frequency signal at a preselected operating frequency bearing encoded information in a trinary (+1, 0, −-1) digital code so as to recover a series of code digits therefrom. Receiver 24 includes an identification code unit 28 arranged to define a local identification code in a form of a predetermined sequence of four trinary digits. In unit 10*b* depicted in FIG. 1, the sequence of this local identification code is "1, 0, −1, 1", whereas unit 10*a* (FIG. 2) uses a different local identification code, for example "0 0 -1 -1". Code unit 28 is arranged to test incoming signals for its particular local identification code and rejects all incoming signals which do not bear this code. Code unit 28 is arranged to pass signals which do bear this local identification code and to emit a valid reception signal whenever a signal bearing the code is received.

Receiver 24 further incorporates a timing latch unit 30 having first and second output states. Timing latch unit 30 is arranged to set itself to the first output state in response to receipt of a valid reception signal from code unit 28. Timing latch unit 30 is also arranged to start timing a predetermined tolerance period, desirably about 1.5 minutes, upon such receipt of a valid reception signal from code unit 28. Additionally, timing latch unit 30 is arranged to reset itself back to the second output state upon lapse of this predetermined tolerance period without receipt of a further valid reception signal from code unit 28. Receiver 24 also includes data recovery unit 32 arranged to provide digital outputs on lines 34 and 36 representing the information in an incoming radio frequency signal which has been passed by code unit 28. Further, receiver 24 includes an AC power failure detection circuit 40 arranged to provide a digital output depending upon whether the receiver is or is not obtaining power from power supply 18. The receiver, and the remaining components of local unit 10 receive power from battery backup unit 22 whenever the power from power supply unit 18 fails.

Local unit 10 further includes a tamper switch 44 mechanically connected to housing 16 and arranged to provide a signal whenever housing 16 is opened. Further, local unit 10 includes a contact request setting unit 46 having an actuator button 48 exposed on the outside of the housing 16. A callout reset unit 50, likewise having an actuator button 52 exposed on the outside of the housing is also included in the local unit. Callout reset unit 50 is connected to an audible alarm 54 disposed within housing 16.

Local unit 10 further includes an encoder 58. Encoder 58 incorporates a four-digit data latch 60 having four separate digital inputs. One such input is connected to the output 39 of power failure detection unit 40. Another input of latch 60 is connected to contact request setting unit 46. A third input of latch 60 is connected to an output 36 of data recovery unit 32, and further connected to reset unit 50. The fourth input 41 of latch 60 is connected to another output 34 of data recovery unit 32 and further connected to tamper switch 44. Latch 60 is arranged to hold each of its four digits in a given state indefinitely, and to change each particular digit to the opposite state only when a signal is received on the appropriate input of the latch. Thus, one digit value in latch 60 can be reset by a signal on receiver data recovery output 34 or by operation of tamper switch 44. Another digital value can be switched between states either by a signal on receiver data recovery output 36 or by a signal from reset unit 50. Yet another value can be switched by a signal from contact request unit 46. The fourth value is switchable by the output of power failure detector 40.

Encoder 58 further includes a code generating unit 62. Unit 62 is arranged to provide a preselected report identification code different from the local receiver code provided by unit 28, but having a predetermined relationship to the local receiver code. As illustrated, the report identification code generated by unit 62 is inverse to the local receiver code. That is, each trinary digit of the four digits in the report identification code is the opposite of the corresponding trinary digit in the local identification code. Encoder 58 is arranged to assemble the report identification code generated by unit 62, the current state output by latch and timing unit 30 and the current contents of latch 60 into a 9-digit digital message. Local unit 10 further includes a report signal transmitter 64 arranged to impress the 9-digit message from encoder 58 on a radio signal at the aforementioned preselected operating frequency, and to send this signal in a burstwise, repetitive mode on a predetermined duty cycle through an antenna 65. Preferably, report transmitter 64 is arranged to send repeated bursts at predetermined intervals spaced about two seconds apart or less, and desirably spaced about one-half second or less. Most preferably, the report transmitter 64 is arranged to send signal bursts at intervals of about 0.16 seconds. Each such signal burst desirably is about three milliseconds long, and includes several copies of the 9-bit message from encoder 58.

Tag 12 includes a tag signal transmitter 66 mounted in a small housing 68. Housing 68, and hence transmitter 66, are secured to the body of the person to be monitored by a strap 70. Strap 70 is permanently secured, as by rivets, around the wrist or ankle of the monitored person. Thus, strap 70 and hence tag transmitter 66 cannot be removed from the monitored person without severing strap 70. Tag transmitter 66 incorporates a severance detection circuit 72 for sensing severance of strap 70. Most preferably, strap 70 and severance detector 72 are arranged in accordance with copending, commonly assigned U.S. Pat. Application No. 200,088, filed May 27, 1988, the disclosure of which is hereby incorporated by reference herein. As more fully set forth in the '088 application, a plurality of electrical conductors (not shown) may be embedded in strap 70 so that the conductors extend side-by-side, lengthwise along the strap. The conductors are normally insulated from one another. Severance detection circuit 72 may be arranged to impose a potential between different ones of these conductors and to sense any momentary current flow between these conductors. Such a circuit can effectively detect attempts to sever the strap. Typically, the conductors are arranged in relatively close juxtaposition with one another to promote contacting of the conductors with one another during any attempt to sever the strap.

Transmitter 66 further includes a self-contained battery power supply 67, an RF sending unit 74 connected to an internal antenna 76 mounted within housing 68, and a code unit 78. Code unit 78 is arranged to define the same four digit trinary local identification code as defined by code unit 28 of the associated local monitoring unit 10. RF sending unit 74 is arranged to assemble the code provided by code unit 78 and the output of severance detection unit 72 into a digital message and to send a radio signal at the preselected operating frequency bearing this digital message. RF sending unit 74 is arranged to repeat this RF signal in a burstwise transmission scheme at a relatively low duty cycle, with relatively long repetition intervals between successive bursts. Desirably, the RF sending unit 74 of tag 12 is arranged to provide the tag signal at repetition intervals of about once every twenty seconds to about once every minute, about once every thirty-to-forty seconds being particularly preferred and about once every thirty-five seconds being most preferred.

Mobile unit 14 includes a manually operable code entry panel 80 incorporating four three-position switches 82, each having a 1 position, a 0 position and a -1 position for accepting a four-digit trinary code input. The mobile unit further includes a non-inverting code selector 84 adapted to select and supply a four-digit trinary code matching the settings of switches 82. Further, the mobile unit includes an inverting code selection device 86 adapted to select a code in which each digit is the inverse of the corresponding digit selected by one of switches 82. Mobile unit 14 includes an callout transmitter 88 and a manually operable callout switch 90. Transmitter 88 is arranged to operate only upon manual actuation of callout switch 90. The callout transmitter is connected to non-inverting code selector 84. Transmitter 88 is arranged to compose a message including the 4-digit code supplied by non-inverting code selector 84 and including a further digit having a predetermined, fixed value indicating that the message is a callout signal. Transmitter 88 is connected to a transmitting antenna 92 and arranged to operate on the aforementioned preselected operating frequency, and to send its message burstwise, on a duty cycle similar to that of report signal transmitter 64. Such burstwise transmission is continued only while callout switch 90 is actuated.

Mobile unit 14 also includes a receiving antenna 94 and receiver 96 connected thereto. Receiver 96 is arranged to accept the 4-digit trinary code provided by inverting code selector 86. Receiver 96 includes apparatus for demodulating radio signals at the preselected operating frequency, and further includes a code unit 97. Code unit 97 is arranged to block reception of any signal which does not bear the 4-digit trinary codes supplied by inverting code selector 86. Receiver 96 provides a valid reception signal output on an output line 98 whenever a signal bearing a 4-digit trinary code matching the code supplied by unit 86 is received and passed by code unit 97. Valid reception output line 98 is connected to an audio buzzer unit 100 arranged to emit a sound in response to each such signal. Receiver 96 is arranged to accept a 9-digit message encoded in the radio frequency signal, to treat the first four digits as an identifying code for comparison in code unit 97 and to treat the remaining five digits of a signal passed by unit 97 as each representing a particular item of status information. The receiver is arranged to pass the signals representing status information through a latching device or decoder 102 to a status reporting panel 104. Thus, each bit as supplied to latching decoder 102, controls the illumination or non-illumination of one lamp **106*a*–106*e***.

The mobile unit 14 further includes a power supply 108 connected to all other elements of the mobile units. Desirably, power supply 108 may include a device for connecting the apparatus to the electrical power supply of a vehicle when the mobile unit is carried on a vehicle.

In operation, tag **12*b* continually transmits a tag radio signal at thirty-five second intervals. This tag signal bears the local receiver code "1 0 −1 1" of the associated local monitoring unit 10*b*. Further, the tag signal carries a digit indicating that severance detection device 72 has not detected any attempts to sever or remove strap 70 from the monitored person. So long as the monitored person remains within his home, the tag 12*b* will remain within range of local unit 10*b*. Therefore, local unit receiver 24 will continually receive the tag signal at thirty-five second intervals. Each such signal causes code unit 28 to provide a valid reception signal. Accordingly, timing latch 30 is reset every thirty-five seconds and never reaches the end of its 1.5 minute predetermined timing period. Timing latch 30 remains in its first or normal output state and continually supplies a digit indicating its first or normal output state and hence indicating that the monitored person is present. Absent any unusual occurrence or any actuation by the monitored person, each of the four digits stored in latch 60 of encoder 58 also remains in a normal state. Thus, the 9-bit message assembled by encoder 58 and supplied to report signal transmitter 64 always includes a message digit indicating presence and four other digits each indicating normal status with regard to another condition, together with the four digits of the report signal identification code (−1 0 1 −1). Report signal transmitter 64 continually sends this same 9**-bit message in bursts at 0.16 second intervals.

If the monitored person goes momentarily to a portion of the home where signal transmission is impaired, the signals from tag unit **12*b* may be momentarily interrupted. If such interruption lasts for about one minute or less, only one transmission from tag unit 12*b* will be missed, and hence timing and latch unit 30 will never reach the end of its full predetermined tolerance time cycle and will never reset itself to its second or absence status. However, if the monitored person goes out of transmitting range for more than about one minute, timing and latch unit 30 will reach the end of its predetermined tolerance timing period, and hence will reset itself to a second or absence output state. In this condition, the message assembled by encoder 58 will include a digit indicating that the timing and latch unit 30** is in its second or absence output state.

If the monitored person attempts to remove the tag 12b from his person by severing strap 70, severance detection circuit 72 will be actuated. A bit indicating this occurrence will be encoded in the next message sent by tag **12*b*. This will cause data recovery unit 32 to provide an appropriate output on output line 34, thus changing one digit stored in latch 60 and changing the corresponding digit in the report signal sent by report signal transmitter 64. Further, if any attempt is made to open the housing 16 of local monitoring unit 10*b*, tamper switch 44 will change the same digit in latch 60 and hence will cause the same change in the report signal. Upon loss of AC power to power supply unit 18, power failure detection circuit 40 will change the assigned power failure digit in latch 60, and hence in the report signal. Moreover, if the monitored person needs to meet with the monitoring officer, he may operate button 48 causing contact request switching unit 46 to change the contact request digit stored in latch 60 and hence also to change the contact request digit of the report signal sent by transmitter 64**.

The monitoring officer has in his possession a list of monitoring locations and local receiver codes associated with each monitoring location. The monitoring officer follows a route which will take him past each monitoring location. As the monitoring officer brings the mobile unit 14 close to a particular monitoring location, he turns the switches 82 of code entry panel 80 to positions matching the local receiver code for that monitoring location. Thus, as the monitoring officer approaches the home where unit **10*b* is installed, he sets the switches 82 to the sequence 1 0 −1 1. This causes the local receiver code to be set in callout transmitter 88 and the inverse report signal code (−1 0 1 -1) to be set in receiver 96 of the mobile unit. Thus, the mobile unit is set to interact with local unit 10*b*. When the report signals from that particular local unit bearing the proper report signal code are received by receiver 96, audio buzzer unit 100 on the mobile unit is actuated. Each new burst of the report signal causes a new actuation of the audio buzzer unit so that the buzzer unit sounds repeatedly while receiver 96 is receiving report signals bearing the appropriate code. The five information digits of the report signal are latched in decoder 102. Each such digit controls one of the status reporting lamps 106 on report panel 104 of the mobile unit. Thus, when the audio buzzer unit 100 sounds, the officer need only look at status panel 104 to ascertain the condition of the particular local unit selected and the person monitored thereby. For example, lamp 106*a* is illuminated only if the presence digit in the report signal is in an abnormal condition, indicating that the local unit is not receiving tag signals from the associated tag unit and hence indicating that the monitored person is not present. Likewise, lamps 106*b* and 106*d* illuminate only where the corresponding digits in the report signal indicate loss of AC power or tampering respectively. Lamp 106*c* will be illuminated only if the monitored person has actuated contact request switching unit 46. If the monitoring officer is at a location which is known to be in range of local unit 10*b*, but audio buzzer unit 100 does not sound, then the monitoring officer knows that something has caused local unit 10*b*** to become inoperative and hence can investigate further.

If the monitoring officer wishes to meet personally with the monitored person, he actuates callout switch 90 while in range of the particular local unit associated with that monitored person. Upon such actuation, transmitter 88 sends a signal bearing the proper local receiver identification code and bearing a digit recognizable by data recovery unit 32. Such a callout signal is received by receiver 24 in the same manner as a tag signal from tag unit **12*b*. However, in response to a digit indicating a callout signal, data recovery unit 32 of local unit receiver 24 changes the output on line 36 from its first or normal state to a second or callout state. In response to this change in status, callout reset unit 50 actuates audible alarm 54. This signals the monitored person that he should appear outside of his home at a preselected location (such as on the street in front of his home) for a meeting with the monitoring officer. Further, in response to the callout signal on output line 36, the callout digit in latch 60 is changed from a normal state to a callout state. The corresponding callout digit in the report signal sent by report signal transmitter 64 also changes from a normal state to a callout state, causing lamp 106*e* on the status panel of mobile unit 14 to illuminate. This confirms to the officer that the callout signal was received by local unit 10*b*. When the monitored person hears the alarm from audible alarm 54, he can acknowledge the callout signal by operating button 52, thereby causing reset unit 50 to switch the callout digit in latch 60 back to its normal state. The monitoring officer will see lamp 106*e* on status panel 104 go out, thus indicating to the officer that the monitored person has acknowledged the call. The officer can send a callout signal at any time while he is within range of the local unit. Typically, the officer will not require the monitored person to appear every time that the officer comes within range but rather will use this capability at random times so that the monitored person will never know when the officer may demand to see him in person. Further, the officer will use the callout capability when the monitored person has actuated the contact request switch 46. If the monitored person has actuated the contact request switch, the officer will see lamp 106*c* illuminated the next time that he monitors the signal from that particular local unit, and may send a callout signal in response so as to arrange for a meeting with the monitored person. After meeting with the officer, the monitored person can manually reset callout request switching unit 46**.

The interaction between the mobile unit and every other local unit is the same as the interaction between the mobile unit and local unit **10*b* except that different codes are employed. Thus, the officer can check the status of many monitored persons by going into the vicinity of each local unit in sequence, thus bringing mobile unit 14 within the report signal transmission range of each local unit 10 in sequence by setting the appropriate codes on panel 80. Where there are several relatively closely spaced monitoring locations, and hence several closely spaced local units, the mobile unit may be within signal range of several local units simultaneously. However, receiver 96 of mobile unit 14 will accept only signals bearing the particular report identification code selected by operation of code entry panel 80 and associated components. Further, the callout signal sent by transmitter 88 will match the local identification code of only one local unit 10. Mobile unit 14** therefore will interact with only one local unit at a time.

Although all of the transmitters and receivers in the system operate on a common frequency, interference between signals does not present an appreciable problem. The repetitive tag signal and repetitive report signal transmitters operate burstwise. Each such transmitter is actually sending a signal only a very small percentage of the time. The intervals between bursts are considerably longer than the individual bursts. For example, a single report signal transmitter 64 sending three millisecond bursts at 0.16 second intervals will be active approximately 1.9% of the time, whereas a tag signal transmitter sending similar bursts at thirty-five second intervals will be active approximately 0.01% of the time. Therefore, the probability of interference between these repetitive signals is minimal, and the probability of interference between these repetitive signals and a callout signal sent by mobile unit 14 is also minimal.

Each local unit 10 and each mobile unit 14 incorporates a transmitter and a receiver operating on the same frequency and using relatively closely spaced antennae. Further, the operative components of the transmitter and receiver within each unit ordinarily are mounted in close proximity to one another, typically within the same housing. Thus, the signal from each transmitter is strongly coupled to the receiver in the same unit. The receiver in each such unit is normally operational at all times. Operation of the receiver is not stopped during operation of the transmitter in the same unit. Although it might first appear that such combined operation could cause overloading of the receiver RF sections, with consequent loss of sensitivity to incoming signals, this normally does not occur. Surprisingly, the sensitivity of the receivers used in this system typically is enhanced. Thus, during the intervals between bursts from a transmitter in a given unit, the receiver in that unit typically has greater sensitivity to incoming signals than a comparable receiver which is not mounted adjacent a transmitter. Although the present invention is not limited by any theory of operation, it is believed that outgoing signals from the transmitter in a particular unit excite the RF receiving section in the receiver of the same unit to the point of instability, and that such excitation renders the RF section in the receiver more sensitive rather than less sensitive to subsequent incoming signals. This effect occurs particularly in superheterodyne receivers. Superheterodyne receivers per se are well-known. A superheterodyne receiver includes a local oscillator adapted to generate a local signal at a frequency different than the frequency of the incoming signal. The receiver further includes a mixer for mixing the local signal with the incoming signal to thereby form a signal having a frequency equal to the beat frequency of the local and incoming signals, i.e., the difference in frequencies between incoming and local signals. Additionally, the receiver include devices for amplifying the beat frequency signal and demodulating it to recover the baseband or transmitted information. Desirably, each local receiver 24 of each local monitoring unit 10 and the receiver 96 of the mobile unit are all superheterodyne receivers.

The receivers and transmitters utilized in the system may all be common, commercially available components of the types utilized in addressable remote control systems. These units typically incorporate additional functional elements such as latches, timers and the like. These additional elements can be utilized as the corresponding functional elements of the structure discussed above. For example, many commercially available transmitters incorporate a latch 60 and code setting section 62 capable of functioning as the encoder 58 of the local unit 10. Moreover, more than one mobile unit may be used in conjunction with the several local units.

As will be appreciated, numerous variations and combinations of the features discussed above can be utilized without departing from the present invention as defined by the claims. Merely by way of example, a local unit 10 need not necessarily detect the presence or absence of the monitored person by detection of a radio frequency tag signal. Thus, the detector means of each local unit 10 may incorporate means for periodically emitting a perceptible action signal and determining whether a predetermined action has been performed by the monitored person.

The aforementioned U.S. Pat. 4,747,120 discloses a system using a passive encoded object carried on a tag worn by the monitored person. The same type of passive object can be used in a variant of this invention. The local monitoring unit in this variant would be arranged to determine whether the encoded object had been engaged with the local unit in response to the action signal. The local unit would adjust the report signal to indicate that the person is present if the encoded object was engaged in response to the last action signal and to indicate that the person is not present if the encoded object was not engaged in response to the last action signal.

As these and other variations and combinations of the features described above may be utilized without departing from the present invention as defined by the claims, the foregoing description of the preferred embodiments should be taken by way of illustration rather than by way of limitation of the present invention as defined in the claims.

I claim:

1. Apparatus for monitoring a plurality of persons at a plurality of preselected monitoring locations comprising:

(a) a plurality of local units each disposed at a monitoring location and associated with a person to be monitored at such monitoring location, each said local unit including detector means for determining the presence or absence of the associated person to be monitored and providing presence or absence information accordingly, each said local unit further including report signal sending means for transmitting a report radio signal bearing said presence or absence information through free space from the monitoring location; and (b) a mobile unit including report signal receiving means for detecting the report signal from the local unit at each said monitoring location while the mobile unit is within range thereof and recovering the presence information from the detected report signal, whereby presence information regarding all of the persons to be monitored can be recovered by bringing said mobile unit within range of all said monitoring locations seriatim.

2. Apparatus as claimed in claim wherein said mobile unit further includes presence status indication means for providing a perceptible indication at said mobile unit of the presence or absence information recovered from each report signal.

3. Apparatus as claimed in claim 2 wherein said mobile apparatus further includes in-range indication means for providing a perceptible indication at said mobile unit whenever said mobile unit is detecting a report signal.

4. Apparatus as claimed in claim 2 wherein said mobile unit includes selectively operable callout signal sending means for sending a callout radio signal, wherein said local unit includes a local unit radio receiver adapted to receive said callout signal, and callout signal indicating means for providing a perceptible indication at the local unit that a callout signal has been received upon reception of said callout signal by the local unit radio receiver.

5. Apparatus as claimed in claim 4 further comprising tag signal means carried by each person to be monitored for transmitting a tag radio signal associated with the monitored person, said radio receiver of each said local unit being adapted to receive the tag radio signal associated with the person assigned to the location of that local unit, said detector means of each said local unit including the radio receiver of that local unit and means for providing a presence signal only if the radio receiver has received the associated tag signal within a predetermined tolerance time and providing an absence signal when the radio receiver of the local apparatus does not receive the associated tag signal within such predetermined tolerance time.

6. Apparatus as claimed in claim 5 wherein the radio receiver of each said local unit includes local code means for defining a local identification code and means for rejecting radio signals which do not bear such local identification code, the local code means in different ones of said local units defining different local identification codes, and wherein the tag signal means associated with each monitored person includes means for encoding the tag signal sent by that tag signal means with the local identification code utilized by the receiver of the associated local unit, said mobile unit including means for selecting any one of said local identification codes and encoding said callout signal with the so-selected local identification code.

7. Apparatus as claimed in claim 6 wherein each said local unit includes means for encoding the report signal sent by the report signal sending means of that local unit with a report identification code, different local units utilizing different report identification codes, and wherein said mobile unit includes report identification code selection means for selecting any one of the report identification codes utilized by said local units the receiver of said mobile unit being arranged to receive only radio signals bearing the so-selected report identification code, whereby the receiver of said mobile apparatus can be set to respond only to report signals from a selected one of said local units.

8. Apparatus as claimed in claim 7 wherein the report identification code utilized by each local unit bears a predetermined relationship to the local identification code utilized by the same local unit.

9. Apparatus as claimed in claim 8 wherein said mobile unit includes manually operable input means for accepting a single manually entered designation, said means for selecting the local identification code and said means for selecting the report identification code being responsive to said single manually entered designation to select the report identification and local identification codes having said predetermined relationship.

10. Apparatus as claimed in claim 9 wherein the report identification code utilized by each local unit is different from the local identification code utilized by the same local unit, and wherein the report signal sending means and local unit radio receiver of each local unit operate on the same frequency.

11. Apparatus as claimed in claim 10 wherein the local unit radio receivers and report signal sending means of all of said local units operate on the same frequency.

12. Apparatus as claimed in claim 8 wherein the local identification code utilized by each local unit includes a series of digital values and wherein the report identification code utilized by each local unit includes a corresponding series of digital values such that each digital value in the report identification code of a particular unit is the inverse of the corresponding digital value in the local identification code utilized by the same local unit.

13. Apparatus as claimed in claim 5 wherein each of said tag signal transmitting means is arranged to send its tag signal repetitively at predetermined tag signal intervals, and each of said report signal sending means is arranged to send its report signal repetitively at predetermined report signal intervals.

14. Apparatus as claimed in claim 13 wherein said predetermined tag signal intervals are longer than said predetermined report signal intervals.

15. Apparatus as claimed in claim 4 wherein each said local unit includes a manually operable callout acknowledgement device and means for altering said report signal in response to operation of said callout acknowledgement device, and wherein said mobile unit includes means for detecting said alteration of said report signal.

16. Apparatus as claimed in claim 13 wherein each said local unit means includes means for encoding its report signal with callout status information having a first content when no callout signal is received and having a second content after call out information has been received, said means for altering said report signal in response to operation of said callout acknowledgement device including means for restoring said call out status information in said report signal to said first status, said means in said mobile unit for detecting alteration of said report signal including means for detecting said callout status information and providing a perceptible indication thereof, whereby a person operating the mobile unit can ascertain that the callout signal has been received by a local unit and can ascertain that the callout signal has been acknowledged.

17. Apparatus as claimed in claim 1 wherein each said local unit includes manually operable contact request means and means for incorporating contact request information in the report signal sent by the local unit in response to actuation of said contact request means, said mobile unit including means for detecting said contact request information and providing a perceptible contact request indication at the mobile unit in response thereto.

18. Apparatus as claimed in claim 1 wherein each said local unit includes means for detecting tampering with the local unit and incorporating tamper information in the report signal sent by the local unit when tampering is detected, said mobile unit including means for detecting said tamper information and providing a perceptible tamper indication at the mobile unit in response thereto.

19. A mobile unit for use in monitoring persons at a plurality of monitoring locations a said mobile unit comprising report signal receiving means for detecting a report signal bearing presence information concerning the presence or absence of a monitored person from a local unit at each said monitoring location while the mobile unit is within range thereof and recovering the presence information from the detected report signal, whereby presence information regarding all of the persons to be monitored can be recovered by bringing said mobile unit within range of all said monitoring locations seriatim, said mobile unit further including presence status indication means for providing a perceptible indication at said mobile unit of the presence information recovered from each report signal.

20. A local monitoring unit for monitoring a person at a monitoring location comprising detector means for determining the presence or absence a person to be monitored and providing presence information accordingly, report signal sending means for transmitting a report radio signal bearing said presence information through free space from the monitoring location, and a local unit radio receiver adapted to receive a callout signal, and callout signal indicating means for providing a perceptible indication at the local unit that a callout signal has been received upon reception of said callout signal by the local unit radio receiver.

21. A local monitoring unit as claimed in claim 20 wherein said local unit radio receiver is adapted to receive a tag radio signal associated with the person assigned to the location of that local unit, said detector means of said local unit including the radio receiver of the local unit and means for providing a presence signal only if the radio receiver has received the associated tag signal within a predetermined tolerance time and providing an absence signal when the radio receiver does not receive the tag signal within such predetermined tolerance time.

22. A method of monitoring a plurality of persons at a plurality of preselected monitoring locations comprising:

(a) operating a plurality of local units, each disposed at a monitoring location and associated with a person to be monitored at such monitoring location, so that each said local unit automatically determines the presence or absence of the associated person to be monitored and provides presence or absence information accordingly, and so that each said local unit automatically transmits a report radio signal bearing said presence or absence information through free space from the monitoring location; and (b) bringing a mobile unit within range of all said monitoring location seriatim, detecting the report signal from the local unit at each said monitoring location while the mobile unit is within range thereof and recovering the presence information from the detected report signal, whereby presence information regarding all of the persons to be monitored is recovered.

* * * * *